US005275187A

United States Patent [19]

Davis

[11] Patent Number: 5,275,187

[45] Date of Patent: Jan. 4, 1994

[54] FOLDABLE WALKER

[75] Inventor: Daniel E. Davis, Terrace Park, Ohio

[73] Assignee: The Kendall Company, Mansfield, Mass.

[21] Appl. No.: 777,808

[22] Filed: Oct. 17, 1991

[51] Int. Cl.[5] ..... A61H 3/00

[52] U.S. Cl. ..... 135/67; 135/74; 482/66; 297/5

[58] Field of Search ..... 135/65, 67, 68, 72, 135/74, 76; 482/66, 68; 297/5-7; 128/25R-25B

[56] References Cited

U.S. PATENT DOCUMENTS

| | | | |
|---|---|---|---|
| 2,437,778 | 3/1948 | Ames . | |
| 3,098,651 | 7/1963 | Murcott | 482/66 |
| 3,387,617 | 6/1968 | Reiber | 135/67 |
| 3,442,276 | 5/1969 | Edwards et al. . | |
| 3,516,425 | 6/1970 | Rigal . | |
| 3,658,079 | 4/1972 | Block . | |
| 3,688,789 | 9/1972 | Bunch | 482/66 X |
| 3,690,652 | 9/1972 | Schneider . | |
| 3,783,886 | 1/1974 | Thomas . | |
| 3,792,887 | 2/1974 | Ramsey . | |
| 3,840,034 | 10/1974 | Smith . | |
| 3,945,389 | 3/1976 | Smith . | |
| 3,993,088 | 11/1976 | Thomas . | |
| 4,012,158 | 3/1977 | Harper . | |
| 4,014,517 | 3/1977 | Keagle . | |
| 4,114,235 | 9/1978 | Remington . | |
| 4,298,016 | 11/1981 | Garelick . | |
| 4,461,471 | 7/1984 | Brastow | 135/74 X |
| 4,481,965 | 11/1984 | Watkins | 135/74 X |
| 4,518,002 | 5/1985 | Battison et al. . | |
| 4,765,355 | 8/1988 | Kent | 297/5 X |
| 4,830,035 | 5/1989 | Liu . | |
| 4,867,438 | 9/1989 | Steckert et al. . | |
| 4,884,799 | 12/1989 | Chai . | |
| 4,907,794 | 3/1990 | Rose . | |

FOREIGN PATENT DOCUMENTS 2076666 12/1981 United Kingdom .

*Primary Examiner*—Carl D. Friedman
*Assistant Examiner*—Lan M. Mai
*Attorney, Agent, or Firm*—Wood Herron & Evans

[57] ABSTRACT

A foldable walker that includes a single latch operator connected with each of left and right latches for the walker's left and right side frames, the left and right latches functioning to latch the left and right side frames open in the use position. Use of the single operator by only one of the user's hands allows both the left and right latches to unlatch the side frames from their open or use position, thereby allowing both those side frames to pivot closed into a collapsed or storage position against the front frame. In preferred form, the left and right latches also function to latch the left and right side frames closed in the storage position. In that preferred form, use of the single operator again by only one of the user's hands allows both the left and right latches to unlatch the side frames from their storage position, thereby allowing both the left and right side frames to pivot back open into the use position relative to the front frame.

23 Claims, 4 Drawing Sheets

FOLDABLE WALKER

This invention relates to walkers. More particularly, this invention relates to foldable walkers in which a walker's side frame is pivotable relative to the walker's front frame between an open or use position and a collapsed or storage position.

Walkers are very well known to the prior art, and have been in use for very many years by patients, as well as the elderly, at hospitals, nursing homes, and in private residences. A walker basically consists of two side frames, each of which is connected with a front frame to complete the walker's framework. The walker's side frames normally each have a hand grip along a top edge so that a user can take a step into the framework while supporting himself with the hand grips, then lift the walker and move it forward, and thereafter take another step into the framework. This permits the user to walk slowly forward while supporting himself with his hands and arms, as well as his legs. The walker is most often used by elderly persons who have trouble walking alone. But the walker also is often used by others such as patients with temporary leg problems or the like.

One of the practical problems associated with use of prior art walkers is the unwieldiness or awkwardness in transporting those walkers from one use site to another, as well as the bulkiness of those walkers for storage purposes when use is not desired. These problems arise, of course, because prior art walkers often are manufactured with the two side frames fixed in position, i.e., immobile, relative to the walker's front frame. In recent years, however, foldable walkers have been developed in which the walker's side frames are foldable relative to the walker's front frame. This allows the walker's side frames to overlap one another and fold against the walker's front frame when transport of the walker from one use site to another is desired, as well as when storage of the walker is desired in, e.g., a cupboard or the like. And this has resulted in walkers which are deemed by many to constitute a significant advance over the original fixed frame walker.

With foldable walkers, however, the walker's side frames must be provided with a latch system that allows those side frames to be firmly and strongly latched in the open or use position relative to the walker's front frame when the walker is to be used by an elderly person or a patient or the like. The latch systems known to date for such prior art foldable walkers are relatively difficult to use compared with the foldable walker of this invention.

Accordingly, it has been a primary objective of this invention to provide an improved foldable walker in which only a single operator handle mounted on the walker frame is connected with the latches for both the walker's left and right side frames in order that only one of the user's hands need be used to unlatch both the latches, thereby allowing the other of the user's hands to pivot both the left and right side frames closed into the folded or storage position relative to the front frame, the latches normally latching the side frames in the open or use position relative to the front frame.

It has been another objective of this invention to provide an improved foldable walker having a latch system in which the side frames are latched both in the open or use configuration, as well as in the closed or storage configuration, relative to the walker's front frame, the walker including only a single operator handle mounted on the walker frame in order that only one of the user's hands need be used to unlatch both the latches from both the use and the storage positions, thereby allowing the other of the user's hands to pivot both the left and right side frames into the collapsed or use positions, respectively.

In accord with these objectives, the improved foldable walker of this invention includes a single latch operator connected with each of left and right latches for the walker's left and right side frames, the left and right latches functioning to latch the left and right side frames open in the use position. Use of the single operator by only one of the user's hands allows both the left and right latches to unlatch the side frames from their open or use position, thereby allowing both those side frames to pivot closed into a collapsed or storage position against the front frame. In preferred form, the left and right latches also function to latch the left and right side frames closed in the storage position. In that preferred form, use of the single operator again by only one of the user's hands allows both the left and right latches to unlatch the side frames from their storage position, thereby allowing both the left and right side frames to pivot back open into the use position relative to the front frame.

Other objectives and advantages of this invention will be more apparent from the following detailed description taken in conjunction with the drawing in which.

Figure 1:
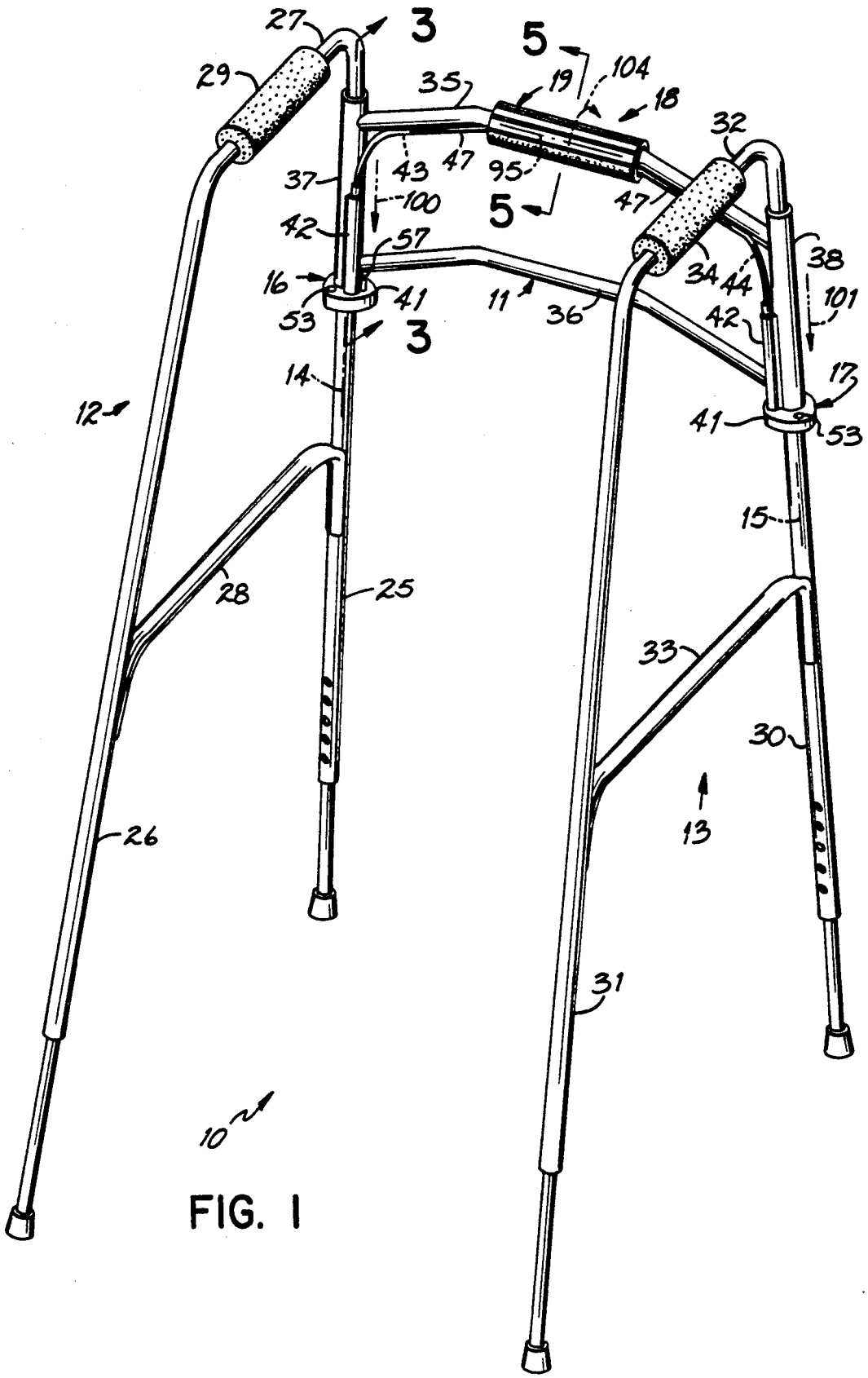
FIG. 1 is a perspective view of a foldable walker in accord with the principles of this invention, the walker's side frames being illustrated in the open or use configuration relative to the walker's front frame.
Figure 2:
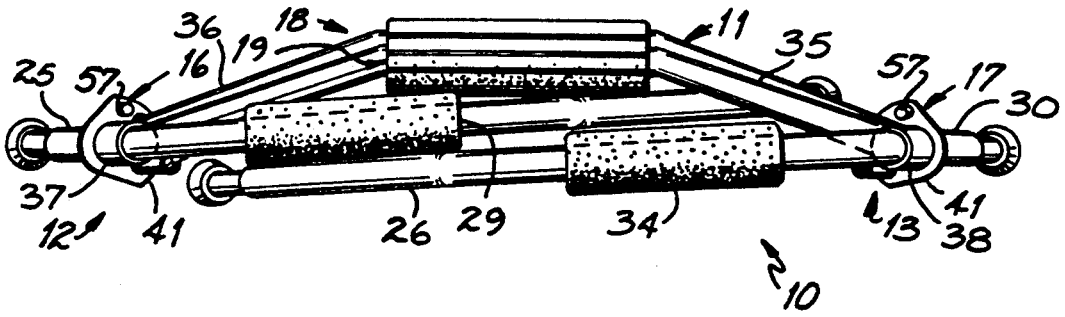
FIG. 2 is a top plan view of the walker illustrated in FIG. 1, the walker's side frames being illustrated in the collapsed or storage position relative to the walker's front frame.

A foldable walker 10 in accord with the principles of this invention is illustrated generally in FIG. 1. The portable walker 10 includes a front frame 11, a left side frame 12 and a right side frame 13, these frames being pivotably connected one with the other on pivot axes 14, 15, respectively. A left latch 16 is partially carried by the front frame 11 and partially carried by the left side frame 12, and a right latch 17 is partially carried by the front frame and partially carried by the right side frame 13. The left 16 and right 17 latches function to latch the left 12 and right 13 side frames, respectively, in the use position relative to the front frame 11 as illustrated in FIG. 1. The left 16 and right 17 latches also function to latch the left 12 and right 13 side frames closed in a storage position relative to the front frame 11 as illustrated in FIG. 2.

A single operator 18 controls the left 16 and right 17 latches mounted on the walker 10. The single operator 18 is connected with each of left 16 and right 17 latches so that use of handle 19 for the single operator 18 by only one of a user's hands will result in both the left and right latches being unlatched. When the foldable walker 10 is in the open or use position illustrated in FIG. 1, this allows both the left 12 and right 13 side frames to pivot closed into the storage position illustrated in FIG. 2. When the foldable walker 10 is in the storage position illustrated in FIG. 2, this allows both the left 12 and right 13 side frames to pivot open into the use position illustrated in FIG. 1.

The walker's left side frame 12 is comprised of a front leg 25, a rear leg 26, and an upper connector brace 27 in generally inverted U-shaped configuration. An intermediate connector brace 28 is fixed between the front 25 and rear 26 legs is provided for structural stability. A hand grip 29 for a user's left hand is mounted on the left side frame's upper brace 27. Similarly, the walker's right side frame 13 includes a front leg 30, a rear leg 31 and an upper connector brace 32 fixed together in generally inverted U-shaped configuration. An intermediate connector brace 33 connects the front 30 and rear 31 legs for structural stability. Also, a hand grip 34 is installed on the right side frame's upper brace 32. The walker's front frame 11 includes spaced upper 35 and lower 36 cross frame members that are held in connected relation by left 37 and right 38 end tubular posts. The end tubular posts receive the front legs 25, 30 of the left 12 and right 13 side frames, respectively, in a slip fit relation. Thus, the front frame's end tubular posts 37, 38 function as bearing sleeves that allow the left 12 and right 13 side frames to pivot relative to the front frame 11 between the FIG. 1 open and FIG. 2 storage positions.

The left 16 and right 17 latches are each partially carried by the front frame 11 and partially carried by the left 12 and right 13 side frames, respectively. Each of the latches 16, 17 is comprised of a latch pin 40 connected with the front frame 11 and a latch plate 41 connected with the respective side frame 12 or 13. Each latch pin 40 and plate 41 are interengaged one with the other when the side frames 12, 13 are open in the use position as shown in FIG. 1, and are also interengaged one with the other when the side frames are closed in the storage position as illustrated in FIG. 2.

Figure 3:
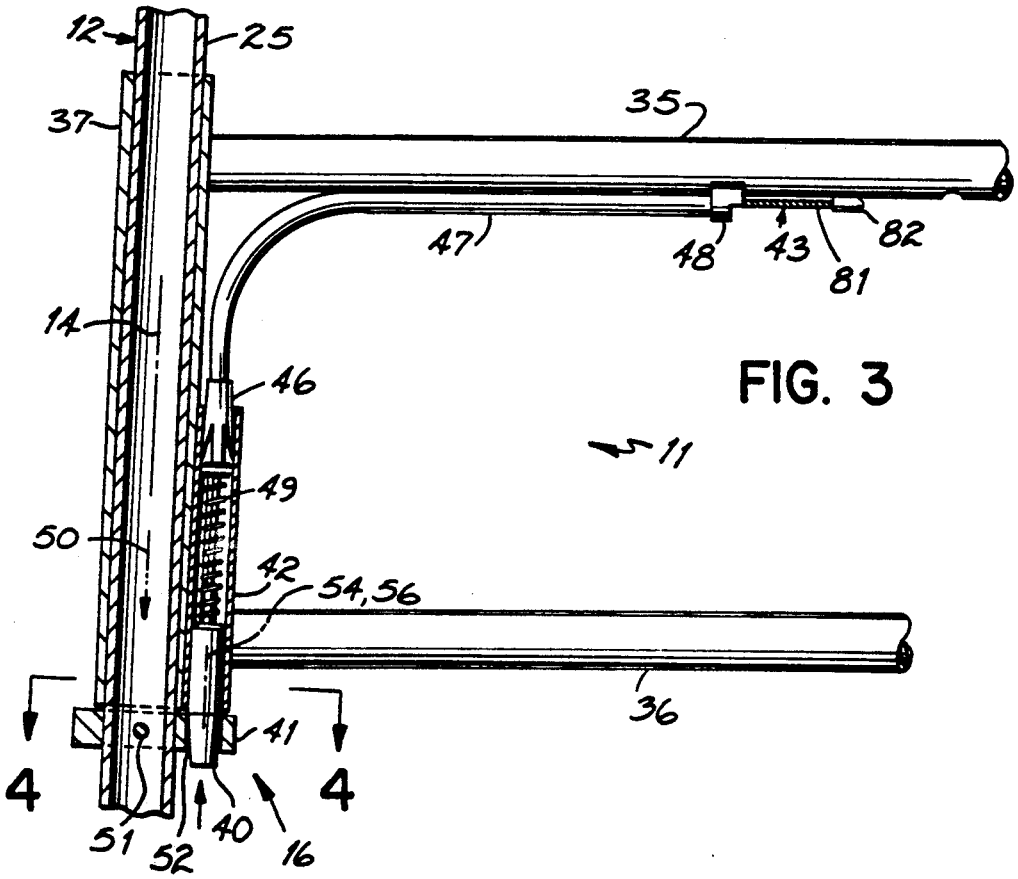
FIG. 3 is a cross-sectional view taken along line 3—3 of FIG. 1.

Each latch pin 40, more specifically, is slideably carried in pin tube 42 fixed to the front frame's tubular post 37 or 38, see FIG. 3. Each latch pin 40 is connected to one end of a left cable 43 or a right cable 44, the other end of the cables 43, 44 being connected to the single operator 18 as described further below. Each latch pin 40 is adapted to extend out the bottom end of the pin tube 42. The top end of each pin tube 42 is closed by a plug 46 press fit into that pin tube. A cable sheath 47 is connected to that plug 46 at one end, and is connected at the other end with top frame member 35 of the front frame 11 through use of a sheath retainer clip 48. A compression spring 49 is interposed in the pin tube 42 between the latch pin 40 and the plug 46 so that the latch pin is continually spring biased in the direction shown by phantom arrow 50 toward latching engagement with the latch plate 41. Note each latch pin 40, therefore, is reciprocable in a direction generally parallel to the longitudinal axis 14 or 15 of the side frame's front leg.

Figure 4:
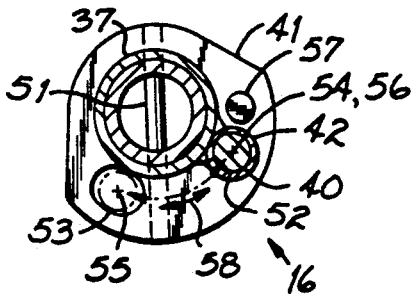
FIG. 4 is a cross-sectional view taken along line 4—4 of FIG. 3.
Figure 6:
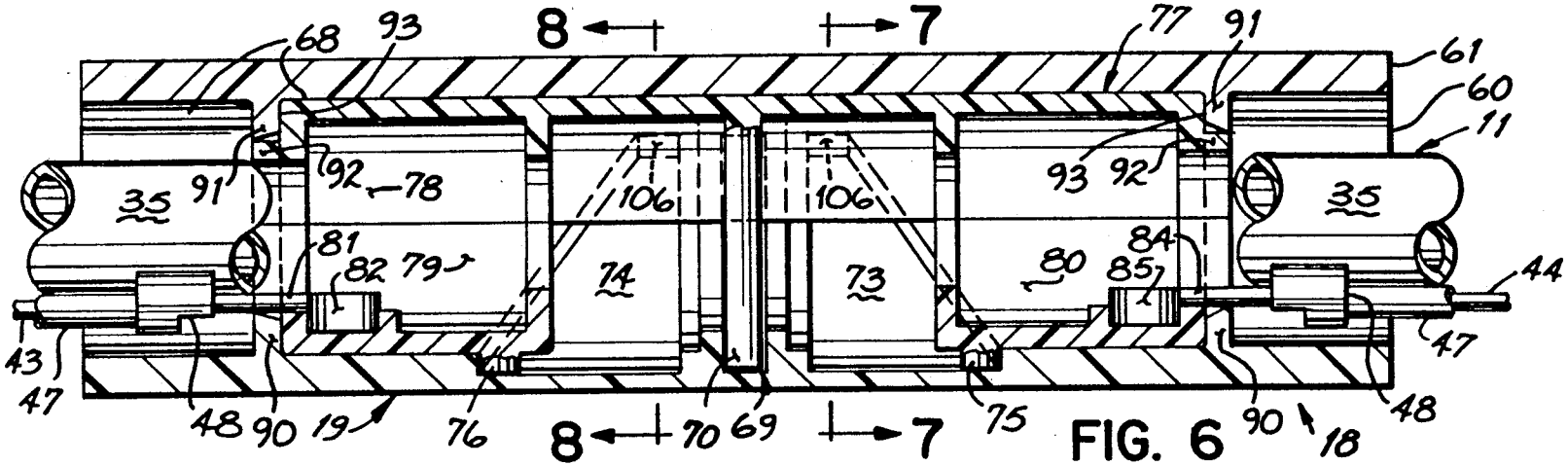
FIG. 6 is a cross-sectional view taken along line 6—6 of FIG. 5 with the handle operator being shown in the latch position.
Figure 8:
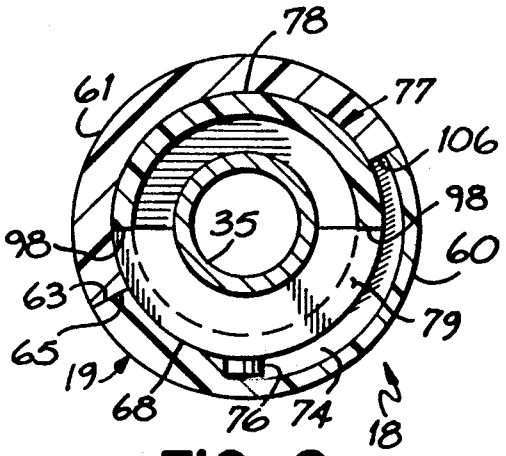
FIG. 8 is a cross-sectional view taken along line 8—8 of FIG. 6.

Each latch plate 41 is fixed to the front leg 25 or 30 of a side frame 12 o 13 by plate pin 51, see FIGS. 3 and 4. Each latch plate 41 includes a walker open pin bore 52 and a walker collapse pin bore 53, the axes 54, 55 of those pin bores being generally parallel to the axis 56 of the latch pin 40. Each latch plate 41 also includes a stop pin 57 against which the pin tube 42 abuts when the side frame 12 or 13 is pivoted toward the open position so as to stop rotation of the side frame in the open or use position. At this open position, of course, each latch pin 40 is spring biased into the latch plate's open bore 52. When the side frame 12 or 13 is pivoted into closure position with the front frame 11 as shown in FIG. 2, abutment of the first closed side frame 12 with the front frame 11, and abutment of the second closed side frame 13 with the first closed side frame, aids in locating closure bore 53 of each latch plate 41 in general alignment with the latch pin 40 so that the spring biased latch pin can latch the side frame in the closure position. Accordingly, each latch plate 40 pivots between the walker open and close positions as the side frames 12, 13 pivot between the open and close positions as shown by the double arrow 58 of FIG. 4.

Figure 9:
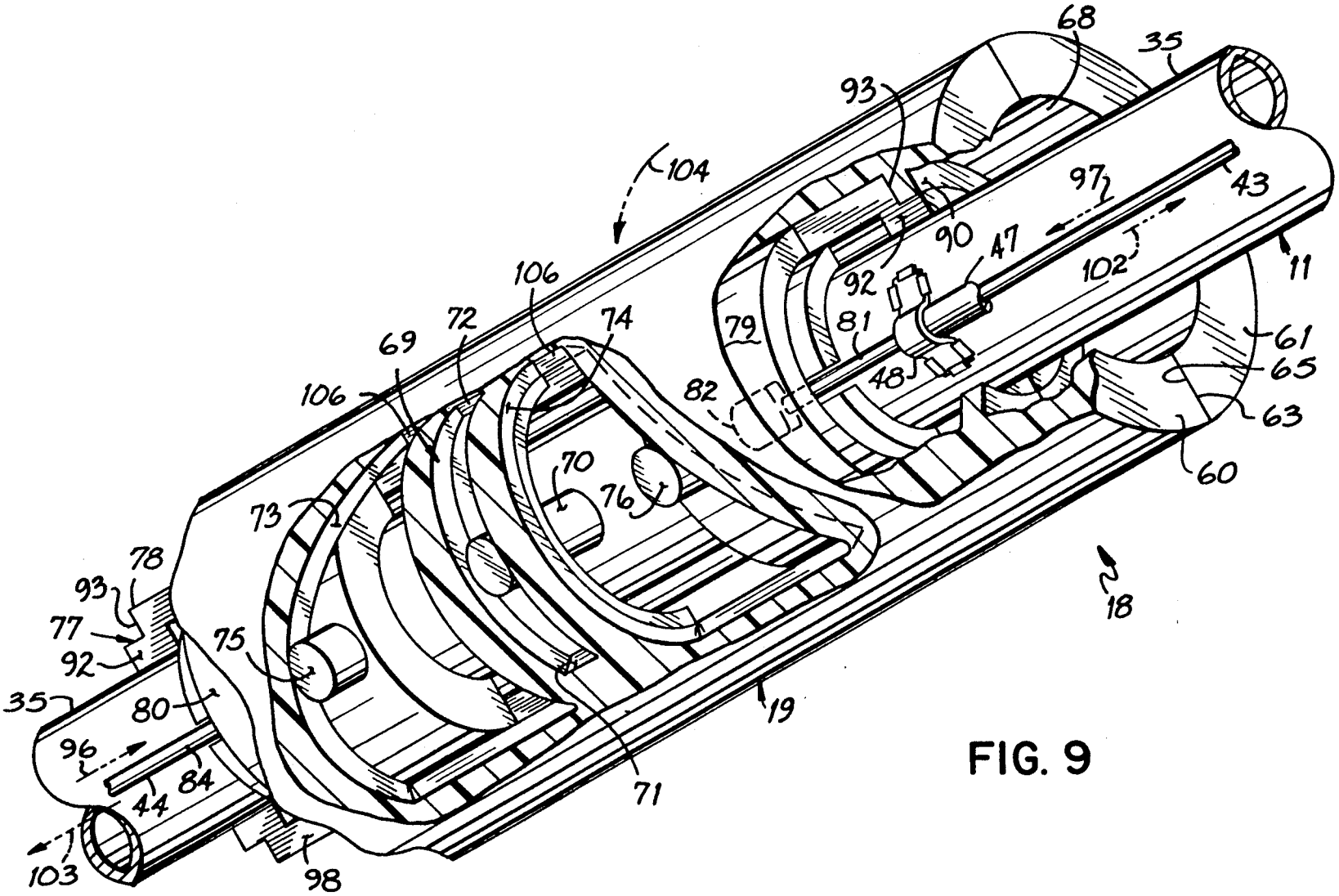
FIG. 9 is a front perspective view, partially broken away, of the handle operator for the walker's latches, the handle operator, the operator being shown in the partially released position.

The left 16 and right 17 latches are connected with the single operator 18, as previously mentioned, which is mounted on the upper cross member 35 of the walker's front frame 11, see FIGS. 1 and 5–9. That upper cross member 35 extends co-axially through the single operator's handle 19. And the left 43 and right 44 latch cables are connected with that operator handle 19 as explained in further detail below. The latch position of the operator handle 19 is illustrated in FIGS. 1 and 5–8, and a partially unlatch position of the operator handle 19 is illustrated in FIG. 9.

Figure 7:
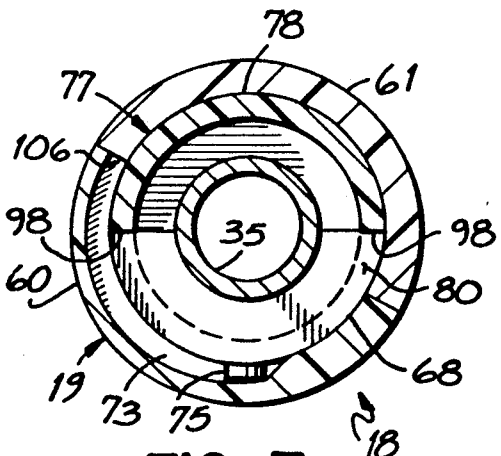
FIG. 7 is a cross-sectional view taken along line 7—7 of FIG. 6.
Figure 5:
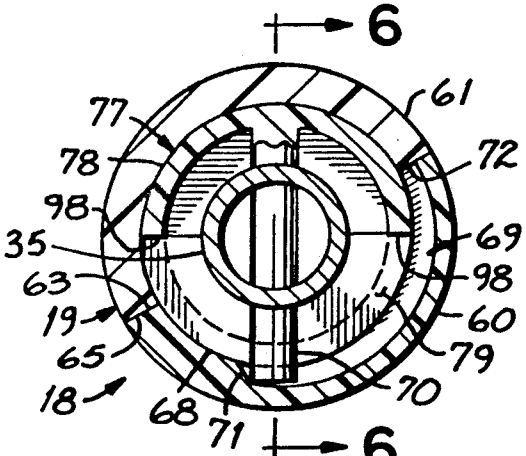
FIG. 5 is a cross-sectional view taken along line 5—5 of FIG. 1.

The handle 19, of operator 18, is comprised of two half shells 60, 61 which are assembled in a manner well known in the plastic parts industry. One 60 of the handle half shells, on its inner surface 68, is provided with a transverse arcuate slot 69 within which a center pin 70, described in detail below, is adapted to ride, see FIG. 7. The ends 71, 72 of this transverse center slot 69 define the two ends of the pivot path of the operator's handle 19 as described in detail below. Note also this same handle half shell 60 includes two cam tracks 73, 74 disposed in mirror relation relative one to the other and to the center slot 69, these two cam tracks being adapted to cooperate with cam pins 75, 76 also described in greater detail below. A tubular slide assembly 77 is concentrically disposed within the handle 19, as well as concentrically disposed on the front frame's upper cross member 35. This slide assembly 77 is comprised of a base half tube 78 on which two separately slideable slide half tube sections 79, 80 are adapted to slide at each end. The left slide half tube section 79 is connected to the free end 81 of the left cable 43 by a ferrule 82, and the right slide half tube section 80 is connected to the free end 84 of the right cable 44 by a ferrule 85. The left slide half tube section 79 carries the cam pin 76 fixed to its outer surface. That left slide cam pin 76 is adapted to cooperate with left cam track 74 defined on the inner surface 68 of the handle half shell 60. The right slide half tube section 80 carries the cam pin 75 adapted to cooperate with right cam track 73 on the handle half shell 60. Note particularly that ribs 90, 91 formed on the inside surface of the half handle shells 60, 61 are adapted to ride on flanges 92 of the base half tube 78, the shoulders 93 of that base half tube holding the handle 19 in centered position, i.e., preventing it from sliding on, the front frame's upper cross member 35. The base half tube 78 itself, as particularly shown in FIG. 7, is held in non-rotating and non-sliding assembly with the front frame's upper cross member 35 by center pin 70 that extends through that front frame's upper cross member 35 and interfits with center pin slot 69 in the handle under surface 68. Each of the left 79 and right 80 slide tube half sections, on the other hand, indeed are slideable on the base half tube 78 in a longitudinal direction parallel to the longitudinal axis 95 of the handle 19 in FIG. 1 as shown by phantom arrows 96, 97 in FIG. 9. In this regard, each of the left 79 and right 80 slide tube half sections slide on edges 98 of the base half tube 78 back and forth between the latch position shown in FIG. 6 and then beyond the position shown in FIG. 6 to a latch release position.

In use of the foldable walker 10 of this invention, the open or use position is illustrated in FIGS. 1 and 3–8. In this walker open position, the latch pins 40 are spring 49 loaded into the open bores 52 of the latch plates 41. This spring 49 loading draws the left 43 and right 44 cables in the direction shown by phantom arrows 100, 101 (FIG. 1) which, in turn, draws the operator's left 79 and right 80 slide tube half sections in the direction shown by phantom arrows 102, 103 (FIG. 9). This, in turn, causes the cam pins 75, 76 fixed to the left 79 and right 80 slide tube half sections to cooperate with the left 74 and right 73 cam tracks on the handle's undersurface 68 so as to pivot the handle 19 into the latch engage position shown in FIGS. 1 and 5–9. Now this latch engage position shown in FIG. 6 for the single operator 18 and handle 19 when the walker 10 is in the open or use position illustrated in FIG. 1 is identical to the latch engage position for single operator 18 and handle 19 when the walker in the collapse or storage position shown in FIG. 2. In the collapse position of the walker 10 shown in FIG. 2, the latch pins 40 are spring 49 loaded into the collapse bores 53 of the latch plates 41. Therefore, and as noted, the normal or usual attitude of the operator handle 19 will be the latch position shown in FIG. 6 as long as the latches 16, 17 are latched as shown in FIG. 3, whether the walker 10 is in the open or use configuration shown in FIG. 1 or in the collapse or storage position shown in FIG. 2.

When it is desired to pivot the walker's left 12 and right 13 side frames from the FIG. 1 use position to the FIG. 2 storage position, or from the FIG. 2 storage position back to the FIG. 1 use position, the operator's handle 19 is simply pivoted or rotated in the direction shown by phantom arrow 104 in FIG. 9 until the cam pins 75, 76 on the left 79 and right 80 slide tube half sections bottom out against ends 106 of the cam tracks 73, 74 in the handle's half shell 60. This causes the left 79 and right 80 slide tube half sections to be drawn inwardly as shown by phantom arrows 96, 97 toward the center pin 70 as shown in FIG. 9. This, in turn, causes the cables 43, 44 to be drawn inwardly in the direction shown by phantom arrows 96, 97 which in turn withdraws the latch pins 40 temporarily from spring 49 loaded engagement with the latch plates 41. When the latch pins 40 are so withdrawn, then of course the walker's left 12 and side 13 frames can be pivoted from either the open to the collapse position or vice versa. It will be particularly noted in this regard, therefore, that only one of a user's hands need be used to operate the handle 19 so as to withdraw both the left and right latch pins 40 when the walker 10 is either to be collapsed or open and that the rotational direction 104 needed to release the latch is a convenient turning or twisting movement for the users wrist. And the latch pins 40 can be easily retained in the withdrawn position by that one of the user's hands until both the left 12 and right 13 side frames have been pivoted to either the use or storage positions as desired, which side frame motion can be accomplished by the other of the user's hands. This, of course, greatly simplifies opening and collapsing of the foldable walker 10.

Having described in detail the preferred embodiment of my invention, what I desire to claim and protect by Letters Patent is:

1. A foldable walker comprising
   - a front frame, a left side frame and a right side frame, said frames being pivotally connected one with the other,
   - a left latch partially carried by said front frame and partially carried by said left side frame, and a right latch partially carried by said front frame and partially carried by said right side frame, said left and right latches functioning to latch said left and right side frames, respectively, open in a use position relative to said front frame, each one of said latches comprising
     - a latch pin connected with one of said front frame and a respective side frame,
     - a latch plate connected to the other of said front frame and said respective side frame, said front frame and said respective side frame being latched open when said latch pin and plate are interengaged one with the other and when said side frames are open in a use position, and
     - a spring connected with said latch pin, said spring normally biasing said latch pin into latching engagement with said latch plate, and
   - a single operator mounted on said walker, said single operator being connected with each of said left and right latches, use of said single operator causing both said left and right latches to unlatch from said use position, thereby allowing both said left and right side frames to pivot closed into a storage position relative to said front frame.

2. A walker as claimed in claim 1, said single operator being mounted on said front frame.

3. A walker as claimed in claim 1, said walker comprising
   - a flexible cable connected between said operator and each of said latches.

4. A walker as claimed in claim 3, said operator being mounted on said front frame.

5. A walker as claimed in claim 3, said left and right latches also functioning to latch at least one of said left and right side frames closed in said storage position, use of said single operator causing both said left and right latches to unlatch from said storage position, thereby allowing both said left and right side frames to pivot open into said use position relative to said front frame.

6. A walker as claimed in claim 5, said front frame and said respective side frame also being latched closed when said latch pin and said latch plate are interengaged one with the other, and when said side frames are closed in a storage position.

7. A walker as claimed in claim 1, said single operator being pivotable between a first position where both said side frames are latched with said front frame and a second position where both said side frames are not latched with said front frame.

8. A walker as claimed in claim 7, said single operator being pivotable on an axis co-axial with a frame member of said walker.

9. A walker as claimed in claim 7, said single operator being pivotable on a top front frame member of said walker.

10. A walker as claimed in claim 7, said single operator comprising a handle pivotally mounted on a frame member of said walker, a slide tube connected to each of said left and right latches, said slide tubes also being slideably mounted on a frame member of said walker, and a cam pin and cam track system partially carried by said handle and partially carried by said slide tubes, said cam pin and cam track system functioning to latch said side frames with said front frame as said single operator is pivoted to said first position and functioning to unlatch said side frames with said front frame as said single operator is pivoted to said second position.

11. A walker as claimed in claim 10, said slide tubes being mounted on that same frame member of said walker to which said handle is mounted.

12. A walker as claimed in claim 11, said handle being pivotable in a pivot plane generally normal to the slide paths of said slide tubes.

13. A handle as claimed in claim 12, said handle comprising tubular housing, said slide tubes being slideable interiorly of said housing.

14. A walker as claimed in claim 13, each one of said latches comprising a latch pin connected with one of said front frame and a respective side frame, a latch plate connected to the other of said front frame and said respective side frame, said front frame and said respective side frame being latched open when said latch pin and said latch plate are interengaged one with the other and when said side frames are open in a use position, and a spring connected with said latch pin, said spring normally biasing said latch pin into latching engagement with said latch plate.

15. A walker as claimed in claim 14, said walker comprising a flexible cable connected between said single operator and each of said latches.

16. A walker as claimed in claim 15, said left and right latches also functioning to latch at least one of said left and right side frames closed in said storage position, use of said single operator causing both said left and right latches to unlatch from said storage position thereby allowing both said left and right side frames to pivot open into said use position relative to said front frame.

17. A walker as claimed in claim 16, said front frame and said respective side frame also being latched closed when said latch pin and said latch plate are interengaged one with the other and when said side frames are closed in a storage position.

18. A foldable walker comprising a front frame, a left side frame and a right side frame, said frames being pivotally connected one with the other so as to move between use position and a storage position, a left latch partially carried by said front frame and partially and fixedly carried by said left side frame, and a right latch partially carried by said front frame and partially and fixedly carried by said right side frame, said left and right latches functioning to latch said left and right side frames open in said use position relative to said front frame, and said left and right latches also functioning to latch at least one of said left and right side frames closed in said storage position, and a single operator mounted on said walker, said single operator being connected with each of said left and right latches, use of said single operator causing both said left and right latches to unlatch from said use position for allowing both said left and right side frames to pivot closed into said storage position relative t said front frame, and use of said single operator also causing said left and right lataches to unlatch from said storage position for allowing both said left and right side frame to pivot open into said use position relative to said front frame.

19. A walker as claimed in claim 18, said single operator being mounted on said front frame.

20. A walker as claimed in claim 18, each one of said latches comprising a latch pin connected with one of said front frame and a respective side frame, a latch plate connected to the other of said front frame and said respective side frame, said front frame and said respective side frame being latched open when said latch pin and plate are interengaged one with the other and when said side frames are open in a use position, and said front frame and said respective side frame also being latched closed when said latch pin and said latch plate are interengaged one with the other and when said side frames are closed in a storage position.

21. A walker as claimed in claim 18, said single operator being pivotable between a first position where both said side frames are latched with said front frame and a second position where both said side frames are not latched with said front frame.

22. A walker as claimed in claim 21, each of said front frames, left side frame and right side frame having a frame member, said single operator being pivotable on an axis co-axial with one of said frame members.

23. A walker as claimed in claim 22, said front frame having a top frame member, said single operator being pivotable on said top frame member.

* * * * *

UNITED STATES PATENT AND TRADEMARK OFFICE

CERTIFICATE OF CORRECTION

PATENT NO. : 5,275,187

DATED : January 4, 1994

INVENTOR(S) : Daniel E. Davis

It is certified that error appears in the above-indentified patent and that said Letters Patent is hereby corrected as shown below:

Column 7, line 32, before "tubular", insert --a--.

Signed and Sealed this

Fifth Day of July, 1994

*Attest:*

Bruce Lehman

BRUCE LEHMAN

*Attesting Officer*

*Commissioner of Patents and Trademarks*